US009291427B2

(12) United States Patent
Cheng et al.

(10) Patent No.: US 9,291,427 B2
(45) Date of Patent: Mar. 22, 2016

(54) SCOPE WITH HEAD LIGHTING ARRANGEMENT

(71) Applicants: Carson Cheng, City of Industry, CA (US); Richard Thomas, City of Industry, CA (US); Jason Michael Cheng, City of Industry, CA (US)

(72) Inventors: Carson Cheng, City of Industry, CA (US); Richard Thomas, City of Industry, CA (US); Jason Michael Cheng, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 136 days.

(21) Appl. No.: 14/261,430

(22) Filed: Apr. 25, 2014

(65) Prior Publication Data

US 2015/0308787 A1 Oct. 29, 2015

(51) Int. Cl.

| | |
|---|---|
| ***F41G 1/38*** | (2006.01) |
| ***F41G 1/34*** | (2006.01) |
| ***F41G 1/387*** | (2006.01) |
| ***F41G 1/02*** | (2006.01) |
| ***F41G 1/06*** | (2006.01) |

(52) U.S. Cl.

CPC .. *F41G 1/34* (2013.01); *F41G 1/02* (2013.01); *F41G 1/06* (2013.01); *F41G 1/387* (2013.01)

(58) Field of Classification Search

CPC ..... F41G 1/34; F41G 1/387; F41G 1/02; F41G 1/06

USPC ..... 42/126, 146; 362/110, 113, 114

See application file for complete search history.

(56) References Cited

U.S. PATENT DOCUMENTS

| | | | | | |
|---|---|---|---|---|---|
| 2,625,764 | A * | 1/1953 | O'Brien | F21L 7/00 | 362/102 |
| 3,481,658 | A * | 12/1969 | Zollner | F41G 1/345 | 359/428 |
| 3,539,798 | A * | 11/1970 | Perry | G03B 21/20 | 353/43 |
| 4,576,451 | A * | 3/1986 | Tominaga | F41G 1/345 | 359/428 |
| 4,660,947 | A * | 4/1987 | Amoils | A61B 3/107 | 351/212 |
| 4,707,772 | A * | 11/1987 | Jimenez | F41G 1/35 | 362/110 |
| 5,052,801 | A * | 10/1991 | Downes, Jr. | G02B 23/14 | 356/153 |
| 6,111,692 | A * | 8/2000 | Sauter | G02B 23/12 | 359/399 |
| 8,497,479 | B1 * | 7/2013 | Garman | G01J 5/06 | 250/352 |
| 2006/0048432 | A1 * | 3/2006 | Staley, III | F41G 1/473 | 42/122 |
| 2014/0002812 | A1 * | 1/2014 | Kepler | G01B 11/272 | 356/138 |

* cited by examiner

*Primary Examiner* — Samir Abdosh

(74) *Attorney, Agent, or Firm* — Raymond Y. Chan; David and Raymond Patent Firm

(57) ABSTRACT

A scope includes a scope assembly and a head lighting arrangement. The scope assembly includes a tubular scope body having an objective end and an opposed sight end to define a scope axis, an objective lens and an eyepiece lens supported at the objective end and the sight end of the scope body respectively for generating a scope reticle, and an attachment base extended from a bottom side of the scope body for detachably mounting the scope body on the firearm to parallelly align the scope axis with a barrel axis of the firearm. The head lighting arrangement includes a plurality of illumination elements formed at a rim of the objective end of the scope body for generating navigation light at a direction aligned with the scope axis of the scope body.

20 Claims, 5 Drawing Sheets

SCOPE WITH HEAD LIGHTING ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a scope, and more particularly to a scope with a head lighting arrangement for a firearm, which is a multifunctional scope for facilitating an operator to hunt in a low light condition environment.

2. Description of Related Arts

Conventional firearm, such as a gun or a rifle, usually needs different firearm accessories for assisting the operator to accurately locate the target and perform the shooting. Scope device, such as a scope, telescope, camera lens module, or binoculars, generally comprises a tubular lens housing and a lens supported in the lens housing. For example, scopes are sighting device and are commonly used in conjunction firearms, such as rifles, to give an accurate aiming point and to aid the operator in properly aligning a barrel of the firearm with a desired target. Accordingly, two lenses are provided at two ends of the lens housing to define an objective end and a sight (ocular) end. The scope further comprises a scope luminous element which is powered by a battery and is operatively provided in the lens housing for illumining a scope reticle thereof.

Another firearm accessory, such as an illumination light module, is mounted on the firearm to provide low light targeting and/or illumination. The illumination light module generally comprises a tubular light housing and a plurality of illumination elements which are powered by a battery and are received in the light housing for light generation. Accordingly, the illumination elements are arranged for generating different colors, wherein red lights are best for preserving night vision, blue light provides high contrast for detecting blood, and white light allows the operator to see clearly under dark environment.

It is worth mentioning that the scope and illumination light module must be mounted on the firearm to parallel to the barrel axis of the firearm. In other words, when the scope is mounted on top of the firearm, the illumination light module must be mounted to the side of the firearm which will block the illumination light by the firearm. If the illumination light module is mounted underneath the firearm, such as the bottom side of the handguard, the gripping area of the handguard will be minimized. It is worth mentioning that the operator requires to individually adjust the alignment of the scope and the illumination light module to align with the barrel axis of the firearm. Furthermore, when the scope and illumination light module must be mounted on the firearm, the operator must individually operate the scope and illumination light module to adjust the brightness of the scope reticle and to selectively adjust the illumination colors respectively. The scope and illumination light module are operated by their own battery supply such that additional weight will be added on the firearm. It is important to minimize the weight of the firearm accessories, so that any kind of additional accessories will be additional duties for the operator.

SUMMARY OF THE PRESENT INVENTION

A main object of the present invention is to provide a scope with a head lighting arrangement for a firearm, which is a multifunctional scope for facilitating an operator to hunt in a low light condition environment, such that the scope provides multiple functions to enhance a practice use of the scope.

Another object of the present invention is to provide a scope with a head lighting arrangement, wherein the head lighting arrangement is located at an objective end of the scope, such that the scope alignment is the same as the light alignment of the head lighting arrangement. In other words, once the operator adjusts the scope alignment in parallel with the barrel axis of the firearm, the light alignment of the head lighting arrangement will be automatically aligned with the barrel axis of the firearm.

Another object of the present invention is to provide a scope with a head lighting arrangement, wherein the head lighting arrangement provides different navigation lights, such as white navigation light and red navigation light, which can support the night vision for the operator and can help the operator quickly adapting in a low light environment.

Another object of the present invention is to provide a scope with a head lighting arrangement, wherein a single integrated control panel is provided at the scope to control both the scope luminous element of the scope and the illumination elements of the head lighting arrangement. Therefore, the operator is able to control the scope and the head lighting arrangement by one hand of the operator, so as to simplify the operations of the scope and the head lighting arrangement by means of one hand operation.

Another object of the present invention is to provide a scope with a head lighting arrangement, wherein an elevation adjustment of the scope is located at the bottom side thereof for scope reticle adjustment to provide a low profile of the scope when the scope is mounted on the firearm.

Another object of the present invention is to provide a scope with a head lighting arrangement, which employs one single power supply to operate with electrical components of the scope and the head light arrangement, so as to minimize the unnecessary component of the scope and to reduce the overall weight of the scope.

Another object of the present invention is to provide a scope with a head lighting arrangement, which does not require altering the original structural design of the scope to mount on the firearm, so as to minimize the manufacturing cost of the head lighting arrangement incorporating with the scope.

Another object of the present invention is to provide a scope with a head lighting arrangement, wherein no expensive or complicated structure is required to employ in the present invention in order to achieve the above mentioned objects. Therefore, the present invention successfully provides an economic and efficient solution for providing an all-in-one scope and illumination configuration to minimize additional firearm accessories on the firearm.

Additional advantages and features of the invention will become apparent from the description which follows, and may be realized by means of the instrumentalities and combinations particular point out in the appended claims.

According to the present invention, the foregoing and other objects and advantages are attained by a scope for a firearm, comprising a scope assembly and a head light arrangement.

The scope assembly comprises a tubular scope body having an objective end and an opposed sight end to define a scope axis, an objective lens and an eyepiece lens supported at the objective end and the sight end of the scope body respectively for generating a scope reticle, and an attachment base extended from a bottom side of the scope body for detachably mounting the scope body on the firearm to parallelly align the scope axis with a barrel axis of the firearm.

The head lighting arrangement comprises a plurality of illumination elements formed at a rim of the objective end of the scope body for generating navigation light at a direction aligned with the scope axis of the scope body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
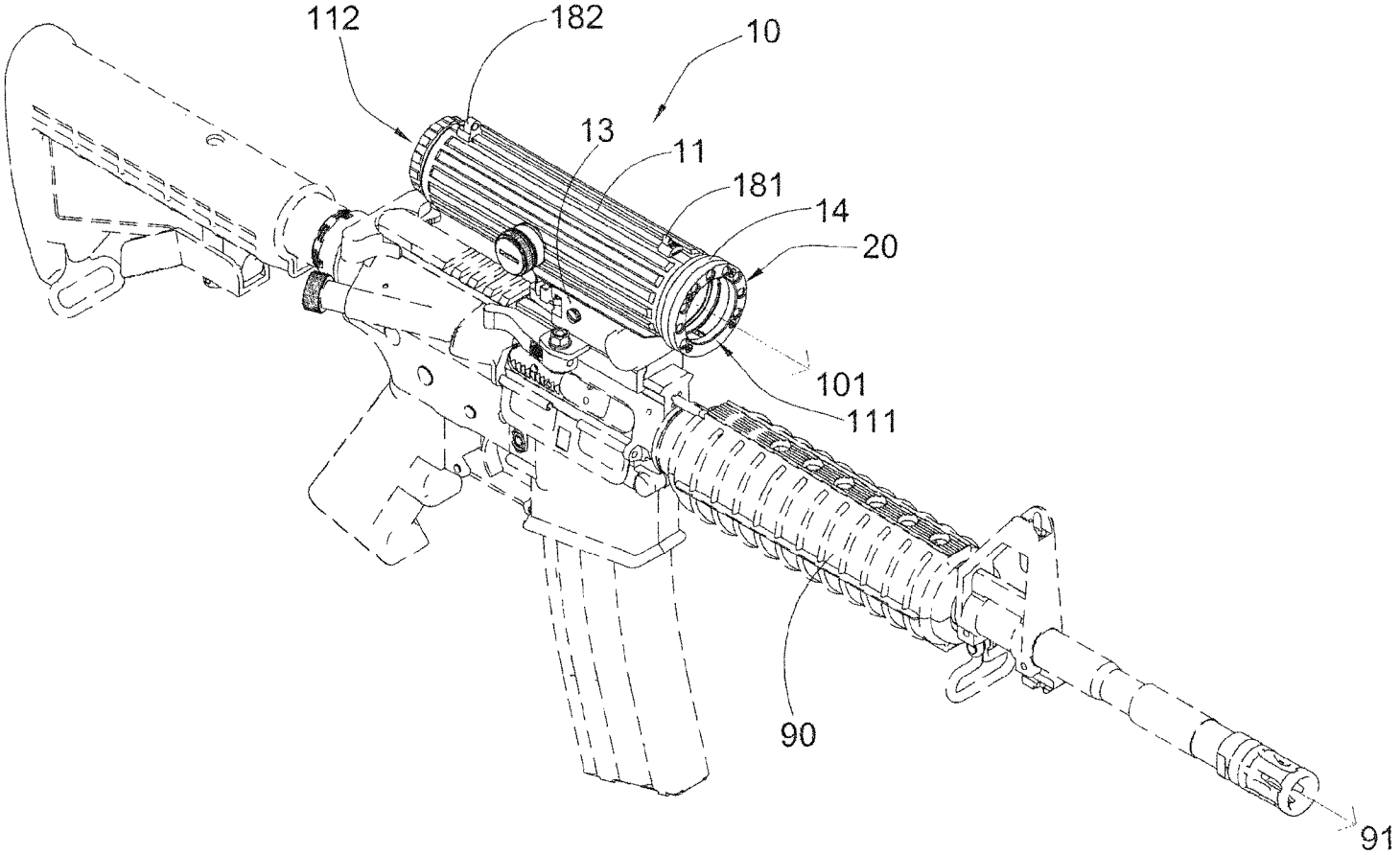
FIG. 1 is a perspective view of a scope with a head lighting arrangement mounted on a firearm according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring FIGS. 1 to 5 of the drawings, a scope for a firearm according to a preferred embodiment of the present invention is illustrated, wherein the scope comprises a scope assembly 10 and a head lighting arrangement 20.

The scope assembly 10 comprises a tubular scope body 11 having an objective end 111 and an opposed sight end 112 to define a scope axis 101, and a lens module 12 comprising an objective lens 121 and an eyepiece lens 122 supported at the objective end 111 and the sight end 112 of the scope body 11 respectively for generating a scope reticle. The scope assembly 10 further comprises a scope luminous element 16 supported within the scope body 11 for illuminating the scope reticle.

The lens module 12 further comprises a protection lens 123 spacedly and coaxially located in front of the objective lens 121 to protect the objective lens 121 and to prevent dust and/or dirt entering into the scope body 11.

According to the preferred embodiment, the scope assembly 10 further comprises an attachment base 13 extended from a bottom side of the scope body 11 for detachably mounting the scope body 11 on the firearm 90 to parallelly align the scope axis 101 with a barrel axis 91 of the firearm 90. Accordingly, the attachment base 13 comprises an upper supporting member 131 downwardly extended from the scope body 11 and a mounting arrangement 132 provided at a bottom side of the supporting member 131 for detachably attaching onto the firearm. The mounting arrangement 132 can be configured to have a "Weaver" mounting structure, a "Picatinny" mounting structure, or "KeyMod" mounting structure to detachably couple at the firearm 90. Preferably, the mounting arrangement 132 is a quick releasing mount comprising a locking lever to rapidly lock and unlock the mounting arrangement 132 at the firearm 90.

Figure 4:
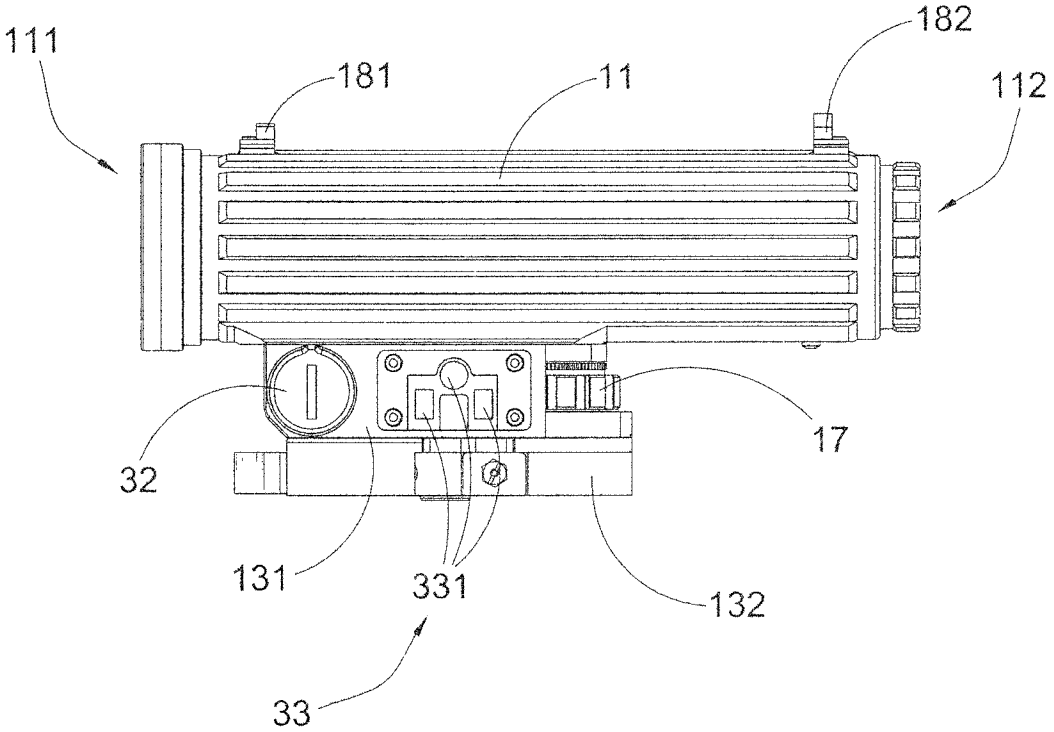
FIG. 4 is a side view of the scope with the head lighting arrangement according to the above preferred embodiment of the present invention.

The scope assembly 10 further comprises an elevation adjustment module 17 formed at the attachment base 14 at a bottom of the scope body 11 for adjusting the scope reticle. As shown in FIG. 4, the elevation adjustment module 17, which comprises an adjustment wheel, is rotatably coupled at an upper portion of the supporting member 131 at a position below the scope body 11 to selectively adjust an elevation of the scope reticle. It is worth mentioning that the operator is able to reach the elevation adjustment module 17 when the operator holds the firearm 90, such that the operator is able to controllably adjust an elevation of the scope reticle by one hand.

Since the elevation adjustment module 17 is formed at the bottom of the scope body 11, it will free up the space on top of the scope body 11. The scope assembly 10 further comprises a back-up iron sight 18 integrally formed on a top side of the scope body 11. Accordingly, the back-up iron sight 18 upwardly extended from the top side of the scope body 11 close to the objective end thereof, and a rear iron sight 182 upwardly extended from the top side of the scope body 11 close to the sight end 112 thereof to align with the front iron sight 181. Preferably, the front iron sight 181 has a blade configuration and the rear iron sight 182 has a ring configuration to align the blade of the front iron sight 181 with an aperture of the rear iron sight 182 to assist in the aiming of the firearm 90.

The head lighting arrangement 20 comprises a plurality of illumination elements 21 formed at a rim of the objective end 111 of the scope body 11 for generating navigation light at a direction aligned with the scope axis 101 of the scope body 11. In other words, the light direction of the head lighting arrangement 20 is also parallel to the barrel axis 91 of the firearm 90.

Figure 2:
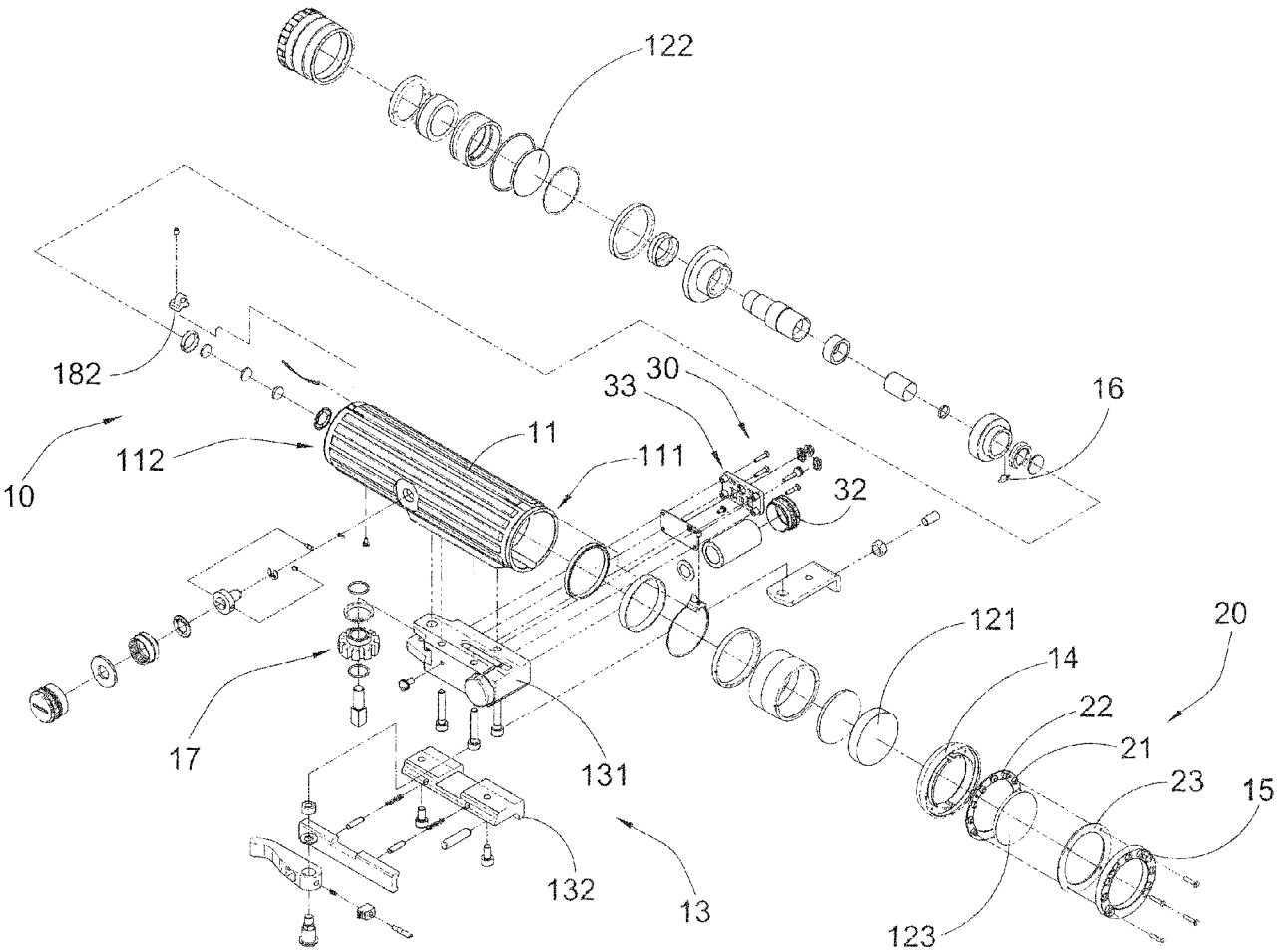
FIG. 2 is an exploded perspective view of the scope with the head lighting arrangement according to the above preferred embodiment of the present invention.
Figure 3:
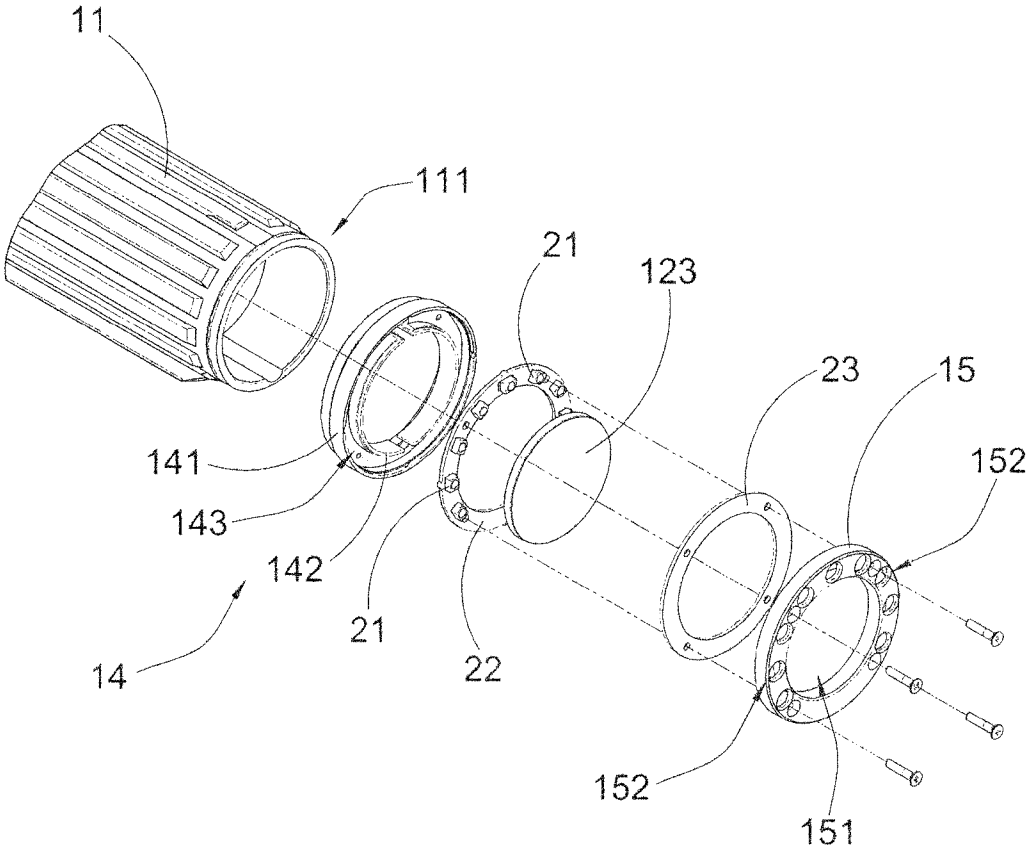
FIG. 3 is an exploded perspective view of lens housing of the scope according to the above preferred embodiment of the present invention.

As shown in FIGS. 2 and 3, the head lighting arrangement 20 further comprises a ring shaped circuit board 22 encircling with the objective end 111 of the scope body 11, wherein the illumination elements 21 are spacedly mounted on the circuit board 22 to be supported at the objective end 111 of the scope body 11.

Each of the illumination elements 21 is a light diode operatively coupled at the circuit board 22 for light generation. Accordingly, the illumination elements 21 are grouped into at least two sets for generating different colors. Preferably, the first set of illumination elements 21 is red navigation light set while the second set of illumination elements 21 is white navigation light set. The red navigation light set will generate red navigation light for preserving night vision. The white navigation light set allows the operator to see clearly under dark environment.

Figure 5:
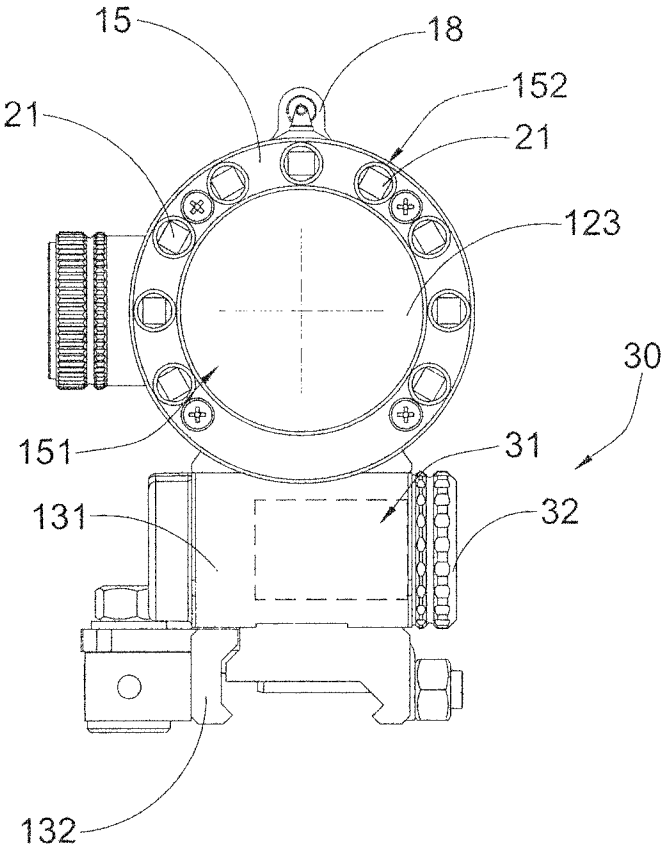
FIG. 5 is a front view of the scope with the head lighting arrangement according to the above preferred embodiment of the present invention.

In order to support the head lighting arrangement 20 at the objective end 111 of the scope body 11, the scope body 11 comprises a lens housing 14 for housing the illumination elements 21, wherein the lens housing 14 is coaxially and frontwardly extended from the objective end 111 of the scope body 11. As shown in FIG. 3, the lens housing 14 has a ring shape coaxially mounted at the objective end 111 of the scope body 11 to house the illumination elements 21 in a circular configuration. In addition, the protection lens 123 is supported by the lens housing 14 and is located coaxially within the illumination elements 21. In other words, the lens housing 14 not only supports the illumination elements 21 but also retains the protection lens 123 in position so as to ensure the illumination elements 21 to encircle around the protection lens 123, as shown in FIG. 5. It should be appreciated that the lens housing 14 can be integrally, coaxially and frontwardly extended from the objective end 111 of the scope body 11 to form a one piece integrated structure.

In particular, the lens housing 14 comprises an outer ring 141 and an inner ring 142 coaxially supported within the outer ring 141 to define a light cavity 143 between the outer and inner rings 141, 142, wherein the illumination elements 21 are spacedly received in the light cavity 143 between the outer and inner rings 141, 142. Accordingly, the diameter size of the circuit board 22 matches with the diameter size of the light cavity 143, such that the circuit board 22 is fittedly supported within the light cavity 143 to support the illumination elements 21 between the outer and inner rings 141, 142.

Also, the protection lens 123 is sealed and supported within the inner ring 142 to ensure the protection lens 123 to be supported in front of the objective lens 121. It is worth mentioning that the protection lens 123 can be a transparent glass to protect the objective lens 121.

The scope assembly 10 further comprises a ring shaped front rim cover 15 attached to the outer and inner rings 141, 142 to enclose the light cavity 143. As shown in FIG. 3, the front rim cover 15 has a center lens window 151 aligned with the protection lens 123 and a plurality of light windows 152 aligned with the illumination elements 21 respectively. Accordingly, the front rim cover 15 is coupled at the lens housing 14 to enclose the illumination elements 21 and the circuit board 22 in the light cavity 143. The light windows 152 are spacedly formed at the front rim cover 15 to align with the illumination elements 21, such that the navigation light generated by the illumination elements 21 will pass through the light windows 152 from the light cavity 143.

According to the preferred embodiment, the head lighting arrangement 20 further comprises a ring shaped transparent panel 23 disposed in the light cavity 143 to cover the illumination elements 21 on the circuit board 22, wherein the transparent panel 23 is located behind the front rim cover 15 to protect the illumination elements 21. Preferably, the transparent panel 23 is made of resin to seal and protect the illumination elements 21 on the circuit board 22. It is worth mentioning that since the illumination elements 21 are light diodes, the light diodes do not have any protection. The existing LED generally comprises the light diode encased within a LED housing. In other words, dust or dirt may be entered into the light cavity 143 through the light windows 152 of the front rim cover 15 to damage the illumination elements 21. Therefore, the transparent panel 23 will protect the illumination elements 21 from getting dust or dirt through the front rim cover 15, so as to prolong the life span of the illumination elements 21.

As shown in FIGS. 2, 4 and 5, the scope of the present invention further comprises an integrated control module 30 provided at the attachment base 13 to operatively link with the scope luminous element 16 of the scope assembly 10 and the illumination elements 21 of the head lighting arrangement 20. In particular, the integrated control module 30 is provided at the supporting member 131 of the attachment base 13 to control the operations of the scope assembly 10 and the head lighting arrangement 20.

Accordingly, the integrated control module 30 comprises a power source compartment 31 formed at a sidewall of the supporting member 131 of the attachment base 13 for receiving a power supply as a single power source to operatively link with the scope luminous element 16 and the illumination elements 21, and a compartment cover 32 detachably coupled at the sidewall of the supporting member 131 of the attachment base 13 to enclose the power source compartment 31. Therefore, the scope luminous element 16 and the illumination elements 21 will share one single power source to reduce the overall weight of the scope on the firearm 90 and to simplify the electrical configuration of the scope with respect to the scope luminous element 16 of the scope assembly 10 and the illumination elements 21 of the head lighting arrangement 20.

The integrated control module 30 further comprises a control panel 33 provided at sidewall of the supporting member 131 of the attachment base 13 for adjustably can rolling a scope reticle illumination, for adjustably controlling a brightness level of the navigation light, and for selecting colors of the navigation light. The control panel 33 comprises a plurality of control switches 331 operatively linked to the scope luminous element 16 and the illumination elements 21 for the operator to selectively adjust the properties of the scope luminous element 16 and the illumination elements 21.

As shown in FIG. 5, there are nine illumination elements 21 radially located at the objective end 111 of the scope body 10. For example, the first and ninth illumination elements 21 are grouped to form the red navigation light set and the second to eighth illumination elements 21 are grouped to form the white navigation light set.

One of the control switches 311 serves as an activation switch to activate the head lighting arrangement 20 in different modes. In the first mode, when the activation switch is pressed or touched, the red navigation light set is activated to generate red navigation light. In the second mode, when the activation switch is pressed again, only the second and eighth illumination elements 21 in the white navigation light set are activated to generate white navigation light. At the same time, the first and ninth illumination elements 21 in the red navigation light set are deactivated. In the third mode, when the activation switch is pressed in a third time, only the second, fourth, sixth, and eighth illumination elements 21 in the white navigation light set are activated to generate white navigation light. The first and ninth illumination elements 21 in the red navigation light set are remained deactivated. In other words, the light intensity of the white navigation light in the third mode is higher than that in the second mode. In the fourth mode, when the activation switch is pressed in a fourth time, all the illumination elements 21 in the white navigation light set are activated to generate white navigation light. The first and ninth illumination elements 21 in the red navigation light set are remained deactivated. In other words, the light intensity of the white navigation light in the fourth mode is higher than that in the third mode. In the fifth mode, when the activation switch is pressed in a fifth time, the illumination elements 21 are deactivated so as to switch off the illumination elements 21. Therefore, the operator is able to not only select the activation between the red navigation light set and the white navigation light set for selecting colors of the navigation light, but also adjust the brightness level of the white navigation light.

Furthermore, two of the control switches 331 serve as a brightness increasing control and a brightness reducing control of the scope reticle. When one of these control switches 331 is pressed or touched, the scope luminous element 16 is activated to illuminate the scope reticle. Then, when the brightness increasing control is pressed or touched, the light intensity of the illumination light generated by the scope luminous element 16 will be increased to illuminate the scope reticle. Likewise, when the brightness reducing control is pressed or touch, the light intensity of the illumination light generated by the scope luminous element 16 will be reduced to illuminate the scope reticle. When the two control switches 331 are pressed or touched at the same time, the scope luminous element 16 is deactivated.

It is worth mentioning that all the control switches 331 are provided at the same sidewall of the supporting member 131 of the attachment base 13, such that the operator is able to easily reach the control switches 331 by his or her finger in order to control both of the operations of the scope assembly 10 and the head lighting arrangement 20. In other words, the integrated control module 30 provides a one hand operation for the operator to control the scope. Therefore, the operator can hold the firearm 90 and operate the integrated control module 30 at the same time.

It is worth mentioning that after the scope assembly 10 is mounted on the firearm 90, the operator is able to adjust the scope axis 101 in parallel with the barrel axis 91 of the firearm 90. Once the scope alignment of the scope assembly 10 is adjusted in parallel with the barrel axis 91 of the firearm 90, the light alignment of the head lighting arrangement 20 will be automatically aligned with the barrel axis 91 of the firearm 90. Therefore, the operator is able to adjust the scope alignment of the scope assembly 10 once to achieve both the scope alignment of the scope assembly 10 and the light alignment of the head lighting arrangement 20 in parallel with the barrel axis 91 of the firearm 90.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A scope for a firearm, comprising:

a scope assembly which comprises:

a tubular scope body having an objective end and an opposed sight end to define a scope axis;

a lens module comprising an objective lens and an eyepiece lens supported at said objective end and said sight end of said scope body respectively for generating a scope reticle; and an attachment base extended from a bottom side of said scope body for detachably mounting said scope body on said firearm to parallelly align said scope axis with a barrel axis of said firearm; and head lighting arrangement which comprises a plurality of illumination elements formed at a rim of said objective end of said scope body for generating navigation light at a direction aligned with said scope axis of said scope body.

2. The scope, as recited in claim 1, wherein said scope body comprises a lens housing formed at said objective end to house said illumination elements in a circular configuration and to support a protection lens of said lens module coaxially within said illumination elements.

3. The scope, as recited in claim 2, wherein said lens housing comprises an outer ring and an inner ring coaxially supported within said outer ring, wherein said illumination elements are spacedly received between said outer and inner rings and said protection lens is supported within said inner ring at a position in front of said objective lens.

4. The scope, as recited in claim 2, wherein said head lighting arrangement further comprises a ring shaped circuit board, wherein said illumination elements are spacedly mounted on said circuit board to be supported in said lens housing.

5. The scope, as recited in claim 3, wherein said head lighting arrangement further comprises a ring shaped circuit board, wherein said illumination elements are spacedly mounted on said circuit board to be supported in said lens housing.

6. The scope, as recited in claim 3, wherein said scope assembly further comprises a ring shaped front rim cover attached to said outer and inner rings, wherein said front rim cover has a center lens window aligned with said protection lens and a plurality of light windows aligned with said illumination elements respectively.

7. The scope, as recited in claim 5, wherein said scope assembly further comprises a ring shaped front rim cover attached to said outer and inner rings, wherein said front rim cover has a center lens window aligned with said protection lens and a plurality of light windows aligned with said illumination elements respectively.

8. The scope, as recited in claim 1, further comprising an integrated control module provided at said attachment base to operatively link with a scope luminous element of said scope assembly and said illumination elements of said head lighting arrangement.

9. The scope, as recited in claim 3, further comprising an integrated control module provided at said attachment base to operatively link with a scope luminous element of said scope assembly and said illumination elements of said head lighting arrangement.

10. The scope, as recited in claim 7, further comprising an integrated control module provided at said attachment base to operatively link with a scope luminous element of said scope assembly and said illumination elements of said head lighting arrangement.

11. The scope, as recited in claim 8, wherein said integrated control module comprises a power source compartment formed at a sidewall of said attachment base for receiving a power supply to operatively link with said scope luminous element and said illumination elements, and a control panel provided at said sidewall of said attachment base for adjustably controlling a scope reticle illumination, for adjustably controlling a brightness level of said navigation light, and for selecting colors of said navigation light.

12. The scope, as recited in claim 9, wherein said integrated control module comprises a power source compartment formed at a sidewall of said attachment base for receiving a power supply to operatively link with said scope luminous element and said illumination elements, and a control panel provided at said sidewall of said attachment base for adjustably controlling a scope reticle illumination, for adjustably controlling a brightness level of said navigation light, and for selecting colors of said navigation light.

13. The scope, as recited in claim 10, wherein said integrated control module comprises a power source compartment formed at a sidewall of said attachment base for receiving a power supply to operatively link with said scope luminous element and said illumination elements, and a control panel provided at said sidewall of said attachment base for adjustably controlling a scope reticle illumination, for adjustably controlling a brightness level of said navigation light, and for selecting colors of said navigation light.

14. The scope, as recited in claim 1, wherein said scope assembly further comprises an elevation adjustment module formed at said attachment base at a bottom of said scope body for adjusting said scope reticle.

15. The scope, as recited in claim 3, wherein said scope assembly further comprises an elevation adjustment module formed at said attachment base at a bottom of said scope body for adjusting said scope reticle.

16. The scope, as recited in claim 13, wherein said scope assembly further comprises an elevation adjustment module formed at said attachment base at a bottom of said scope body for adjusting said scope reticle.

17. The scope, as recited in claim 1, wherein said illumination elements are light diodes.

18. The scope, as recited in claim 16, wherein said illumination elements are light diodes.

19. The scope, as recited in claim 1, wherein said scope assembly further comprises a back-up iron sight integrally formed on a top side of said scope body.

20. The scope, as recited in claim 18, wherein said scope assembly further comprises a back-up iron sight integrally formed on a top side of said scope body.

* * * * *